US012013208B2

(12) United States Patent
Zum Mallen

(10) Patent No.: US 12,013,208 B2
(45) Date of Patent: Jun. 18, 2024

(54) SLING ADJUSTMENT AND A WEAPON SLING INCLUDING THE SLING ADJUSTMENT

(71) Applicant: Jonathan David Zum Mallen, Cornville, AZ (US)

(72) Inventor: Jonathan David Zum Mallen, Cornville, AZ (US)

( * ) Notice: Subject to any disclaimer, the term of this patent is extended or adjusted under 35 U.S.C. 154(b) by 0 days.

(21) Appl. No.: 17/868,436

(22) Filed: Jul. 19, 2022

(65) Prior Publication Data

US 2023/0016382 A1 Jan. 19, 2023

Related U.S. Application Data

(60) Provisional application No. 63/223,448, filed on Jul. 19, 2021.

(51) Int. Cl.
*F41C 33/00* (2006.01)
*A44B 11/12* (2006.01)

(52) U.S. Cl.
CPC ..... *F41C 33/002* (2013.01); *A44B 11/125* (2013.01)

(58) Field of Classification Search
CPC ..... A44B 11/12; A44B 11/125; A44B 11/065; F41C 33/002; F41C 33/001; F41C 23/02; Y10T 24/4016
See application file for complete search history.

(56) References Cited

U.S. PATENT DOCUMENTS

| | | | | |
|---|---|---|---|---|
| 5,371,926 | A * | 12/1994 | Van Noy | A44B 11/12 24/171 |
| 8,733,601 | B2 | 5/2014 | Burnsed, Jr. | |
| 9,835,407 | B2 * | 12/2017 | McLean | F41C 33/002 |
| 11,156,434 | B1 * | 10/2021 | Burnsed, Jr. | F41C 33/002 |
| 11,274,902 | B1 * | 3/2022 | Burnsed, Jr. | F41C 33/002 |
| 2020/0224999 | A1 * | 7/2020 | Brown | F41C 33/002 |
| 2020/0271413 | A1 * | 8/2020 | Dilling | A45C 13/30 |
| 2021/0215452 | A1 * | 7/2021 | Robinson | F41C 23/02 |

* cited by examiner

*Primary Examiner* — Corey N Skurdal

(57) ABSTRACT

The disclosure provides a sling adjustment for increased reliability and performance compared to conventional cam and slide adjustments. The disclosed sling adjustment is a single hardware piece that includes a slider and a cam. The sling adjustment includes an antilock wedge to prevent or at least reduce binding when using the sliding feature in the tightening direction. Extruded pins are also disclosed that can reduce the cost and the number of components that are needed for reliable performance. In one example, the sling adjustment includes: (1) a slider having a pair of side walls, and (2) a cam, positioned within the pair of side walls, having an antilock wedge and a center slider bar, wherein the antilock wedge is located on a forward side of the center slider bar.

20 Claims, 7 Drawing Sheets

SLING ADJUSTMENT AND A WEAPON SLING INCLUDING THE SLING ADJUSTMENT

CROSS-REFERENCE TO RELATED APPLICATION

This application claims the benefit of U.S. Provisional Application Ser. No. 63/223,448, filed by Jonathan David Zum Mallen on Jul. 19, 2021, entitled "A SLING ADJUSTMENT AND A WEAPON SLING INCLUDING THE SLING ADJUSTMENT," commonly assigned with this application and incorporated herein by reference in its entirety.

TECHNICAL FIELD

This application is directed, in general, to a weapon sling and, more specifically, to a weapon sling with multiple adjustments.

BACKGROUND

Slings are used with weapons, such as rifles, bazookas, or grenade launchers, to retain or carry the weapon when a user needs to be hands-free and to provide support while shooting. When using a sling there are three basic levels of tightness that correspond to the positions of FIG. 1, wherein a rifle is used as an example of a weapon. Level 1 corresponds to position 1 wherein the sling is all the way loose to allow for easy removal and manipulation of the weapon. Level 2 corresponds to position two wherein the sling is sized to be tight went in the proper shooting position giving additional support for offhand shooting. Level 3 corresponds to position 3 wherein the sling is all the way tight to the body allowing one to be hands-free without the rifle dangling or dipping the muzzle in the mud.

SUMMARY

In one aspect, the disclosure provides a sling adjustment. In one example, the sling adjustment includes: (1) a slider having a pair of side walls, and (2) a cam, positioned within the pair of side walls, having an antilock wedge and a center slider bar, wherein the antilock wedge is located on a forward side of the center slider bar.

In another aspect, the disclosure provides a weapon sling. In one example, the weapon sling includes: (1) a first piece of web, and (2) a sling adjustment integrated with a portion of the first piece of web, wherein the sling adjustment includes a slider having a pair of side walls and a cam, positioned within the pair of side walls, having an antilock wedge and a center slider bar, wherein the antilock wedge is located on a forward side of the center slider bar.

In yet another aspect, the disclosure provides a weapon assembly. In one example, the weapon assembly includes: (1) a weapon, and (2) a weapon sling connected to the weapon, the weapon sling including: a first piece of web connected to an end of the weapon, and a sling adjustment integrated with a portion of the first piece of web, wherein the sling adjustment includes a slider having a pair of side walls, and a cam positioned within the pair of side walls and having an antilock wedge positioned on a forward side of a center slider bar of the cam.

BRIEF DESCRIPTION

Reference is now made to the following descriptions taken in conjunction with the accompanying drawings, in which.

Figure 2:
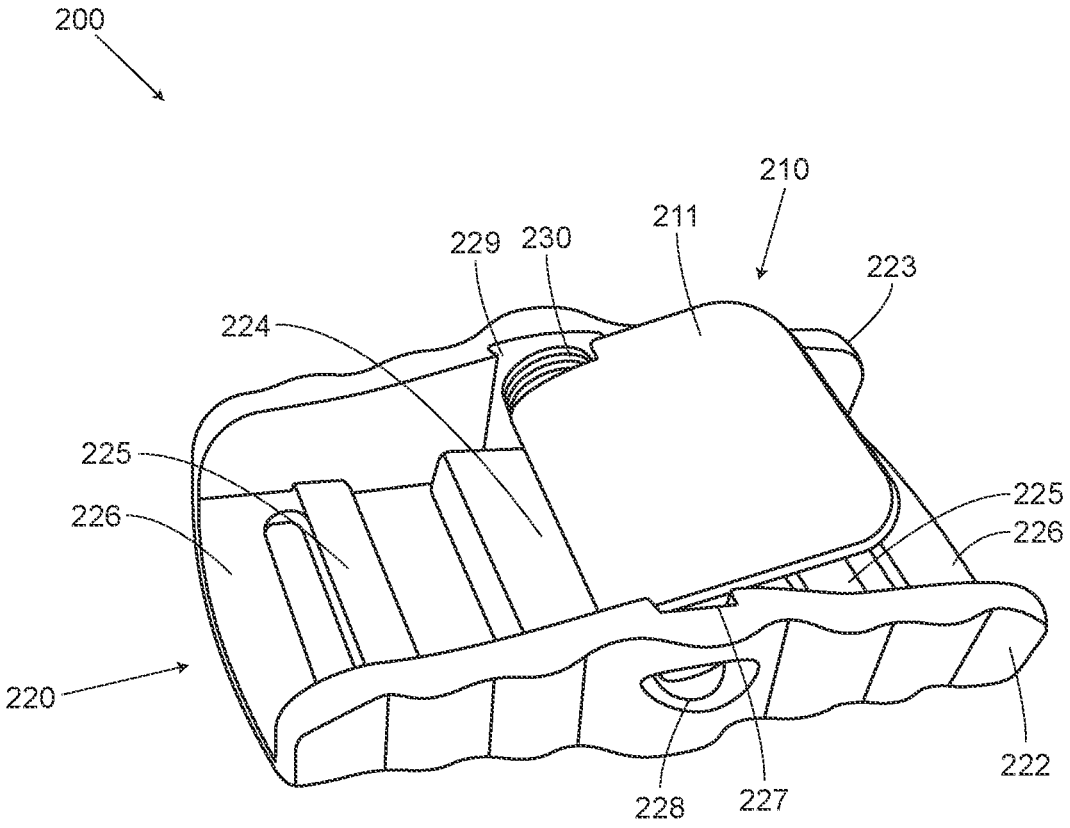
FIG. 2 illustrates a view of an example of a sling adjustment constructed according to the principles of the disclosure.
Figure 4:
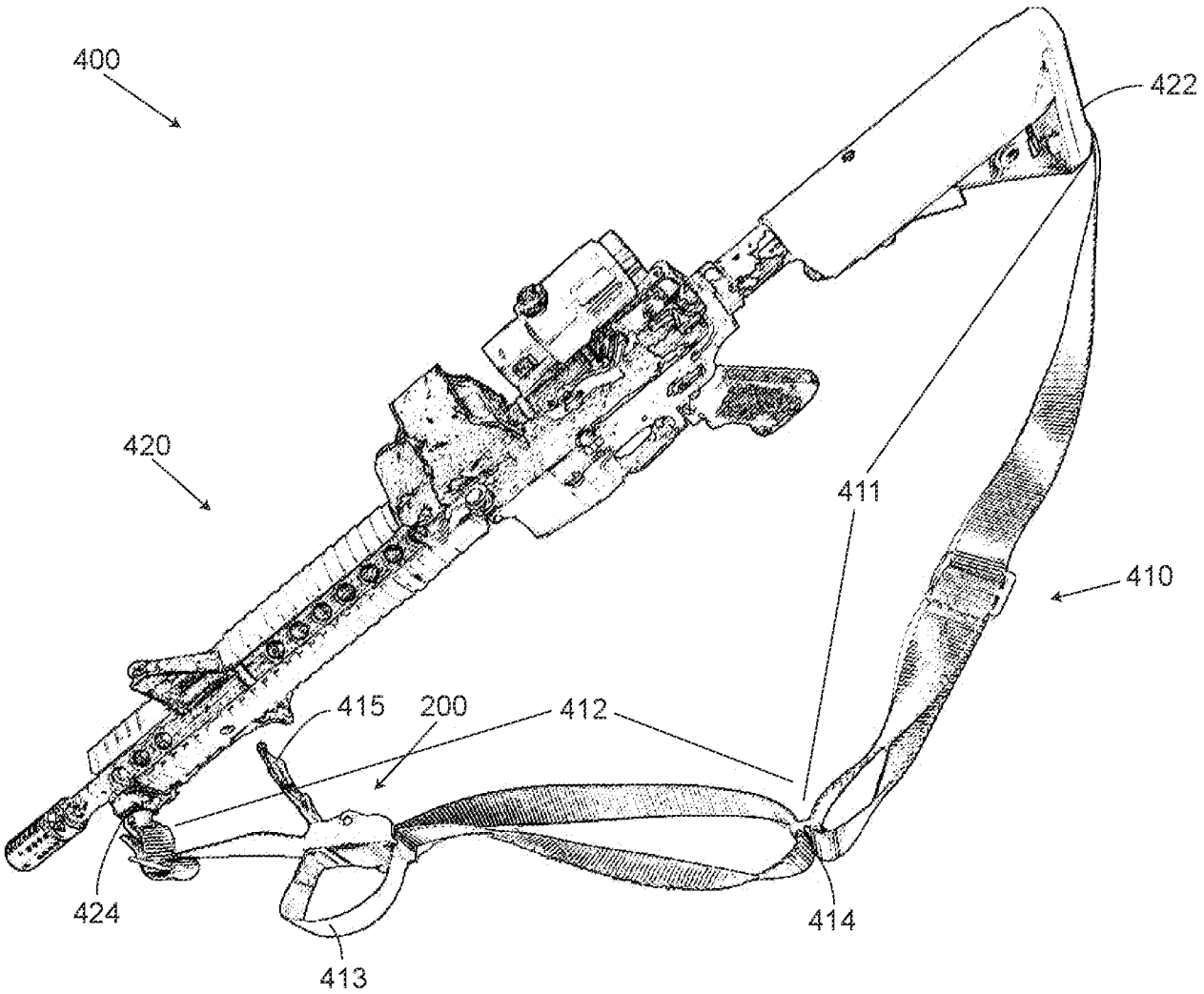
FIG. 4 illustrates an example of a weapon assembly assembled according to the principles of the disclosure.
Figure 5:
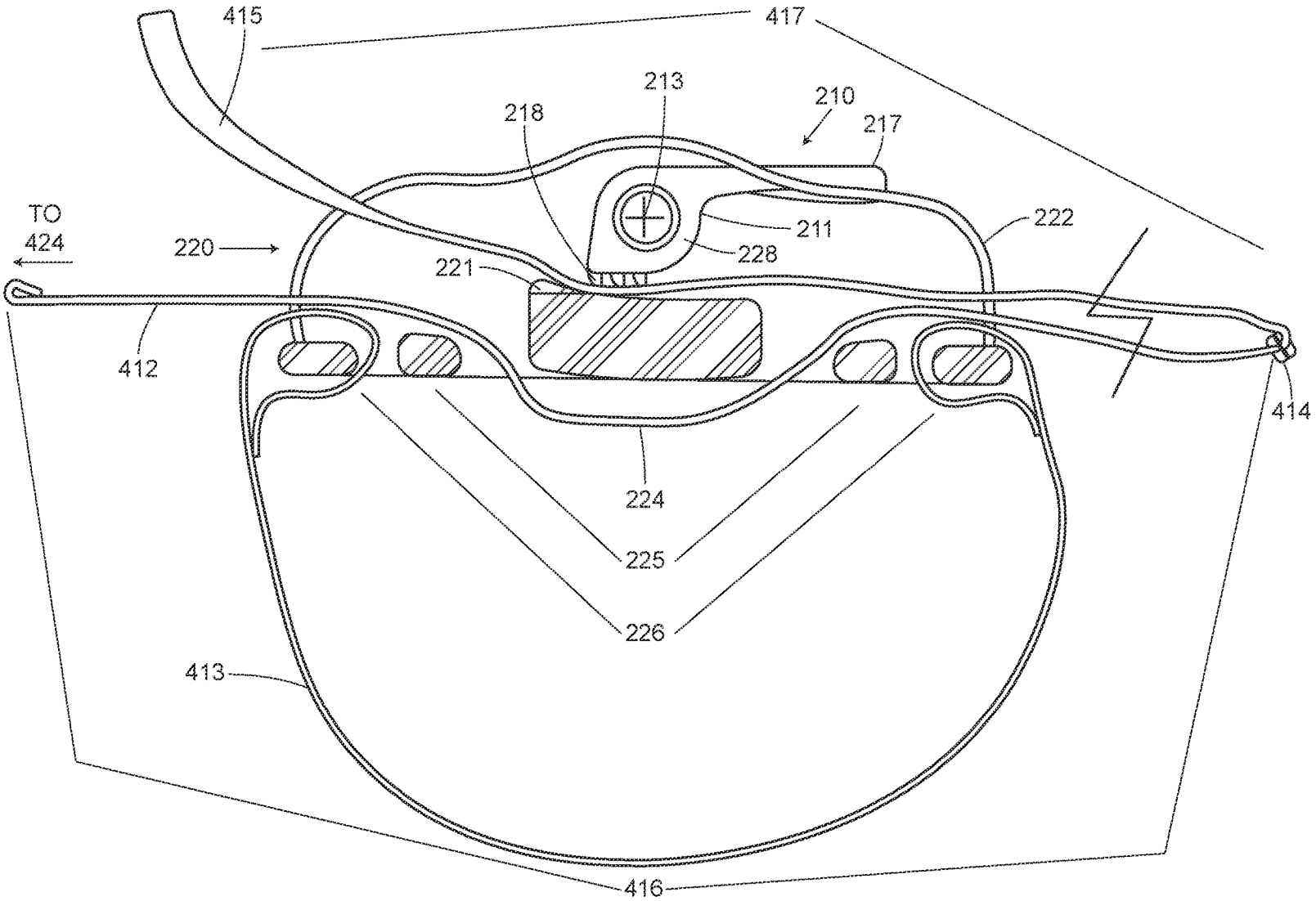

FIG. 5 provides a sideview of the sling adjustment of FIG. 2 interacting with a slider side and an over tighten side of a web of a sling of the weapon assembly of FIG. 4; and FIGS. 6A to 6E illustrate different views of the cam of FIG. 2 showing various components.

DETAILED DESCRIPTION

Figure 1:
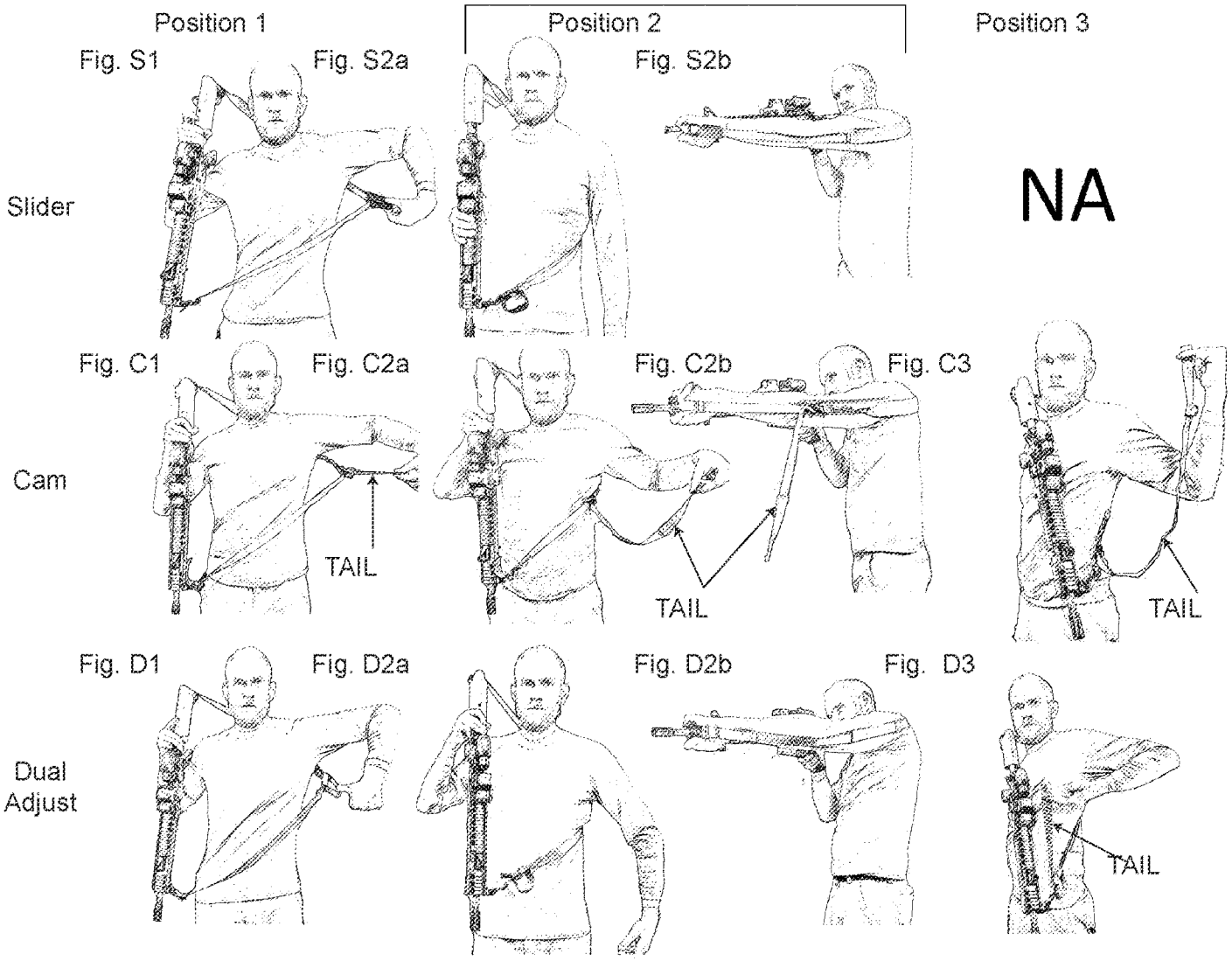
FIG. 1 illustrates examples of three different types of rifle positions, positions one, two, and three, and how the sliders and cams can be used with each the three positions.

A user can adjust a sling to obtain the different levels of tightness for various rifle positions, such as shown in FIG. 1. For two-point adjustable slings, there are two basic types of adjustments that are typically used to place the rifle in the different positions: sliders and cams. FIG. 1 illustrates examples of three different types of rifle positions, positions one, two, and three, and how the sliders and cams can be used with each the three positions. The first row of FIG. 1 illustrates adjustments using a slider, the second row of FIG. 1 illustrates adjustments using a cam, and the third row of FIG. 1 illustrate adjustment using both a slider and cam. As denoted in FIG. 1, just a slider adjustment is not applicable for position 3.

Sliders allow a rifle to be placed in position one and position two as shown in FIG. 1. Position one can be obtained by sliding the slider all the way to the rear. Position 2 can be obtained by sliding the slider all the way forward. The slider, however, can never go tighter than all the way forward. As such, reaching position 3 is prevented when using just a slider. A cam can allow for all three positions of FIG. 1 to be reached. However, when reaching positions two and three, there is a tail that can snag on gear, door knobs, branches, etc. Examples of a tail are noted in FIGS. C1, C2*a*, C2*b*, and C3 of FIG. 1.

By combining both a slider and a cam on one piece of hardware, position one and two can be reached without any tail (see, for example, FIGS. D1, D2*a*, and D2*b* of FIG. 1) and position three can be reached with half as much tail as a traditional cam only design (see FIG. D3 compared to FIG. C3). The conventional combination of the slider and cam, however, can result in binding for the web of the sling and prevent the use of the sliding feature in the tightening direction. The combination of both a slider and cam can also increase the cost and complexity of a sling adjustment. With the added complexity, the possibility of something breaking or malfunctioning can increase and reduce the lifetime of reliable use.

The disclosure provides an improved sling adjustment that provides increased reliability and performance compared to conventional cam and slide adjustments. The disclosed sling adjustment is a single hardware piece that includes a slider body (also referred to as a slider herein) and a cam. The sling adjustment includes an antilock wedge to prevent or at least reduce binding when using the sliding feature in the tightening direction. Extruded pins are also disclosed that can reduce the cost and the number of components that are needed for reliable performance. Using a different thickness or diameter of anchor rods (or bars) used with a grip loop web are further disclosed to decrease friction and increase service life of the grip loop web and a slider web by deconflicting the location of the grip loop web in relation to the routing of the slider web around slider bars. Multiple components of the sling adjustment can be constructed via an injection molding process. Components of the sling adjustment can be formed via a type of plastic material used with injection molding. Acetal is an example of a material used in the injection molding process for the sling adjustment. The sling adjustment can also include a spring around at least one end of the extruded pin. The spring used in the sling adjustment can be constructed of metal.

Turning now to FIGS. 2 to 6, various features of the improved sling adjustment will be further discussed. Some of the elements referred to in the discussion of different figures may not be illustrated or denoted in that particular figure but are shown in other figures that provide a different view or perspective of how the elements cooperate and fit together.

FIG. 2 illustrates a view of an example of a sling adjustment 200 constructed according to the principles of the disclosure. The sling adjustment 200 includes a cam 210, a slider 220, and a spring 230. The cam 210 includes a cam body 211, a pin 212, support ribs 216, a thumb tab 217, teeth 218, and a spring recession 219. In FIG. 2, the cam body 211 is clearly visible.

The slider 220 includes an antilock wedge 221 that is not clearly visible in FIG. 2 and is clearly shown in FIG. 5. The slider also includes a body with opposing walls 222, 223. Extending between the walls 222, 223, are center slider bar 224, two slider bars 225 (also referred to as slider rods) located on either side of the center slider bar 224, and two grip anchor bars 226 located on either side of the slider bars 225 opposite of the center slider bar 224. The antilock wedge 221 is on the forward side of the center slider bar 224. The top of the center slider bar 224 can be referred to as a cam pad. The grip anchor bars 226 serve as anchor points for a grip loop from which a user or operator controls the slider 220. The slider 220 also includes a slider body assembly ramp 227, a pin hole in each of the walls 222, 223, that are collectively denoted as pin holes 228, and a spring pocket 229. Slider body assembly ramps 227 can be integrated with wall 222 and 223, and the spring pocket 229 can be integrated with wall 223.

In FIG. 2 the cam 210 is assembled with the slider 220. The pin 212 of the example sling adjustment 200 is an extruded pin that has extruded pin ends 213, 214. The extruded pin ends 213, 214, refer to opposite extruded ends that extend from the cam body 211 and form the extruded pin 212. Using the extruded pin 212 can reduce the cost and decrease the number of components needed for assembly since the extruded pin 212 (i.e., extruded pin ends 213 and 214) are extruded from the cam body 211. Thus, a separate pin is not needed in this example to secure the cam 210 to the slider 220. In other examples, a separate pin can be used with other features of the disclosure instead of the extruded pin 212 and extruded pin ends 213, 214. In such examples, a cylinder or partial cylinder that corresponds to the separate pin would be located (e.g., formed during manufacturing) in the cam body 211 or attached to the cam body 211 to receive the separate pin.

Advantageously, the walls 222, 223, of the slider body can flex to allow the pin holes 228 to accept the extruded pin ends 213, 214. To aid in fast and proper alignment, pin assembly ramps 215 are located in the bottom edge of both extruded pin ends 213, 214 and corresponding slider body assembly ramps 227 in the side walls 222 and 223. A slider body assembly ramp 227 of the wall 223 is visible in FIG. 3B. The assembly ramps 227 can be cut or formed into the particular positions at an angle that corresponds to an angle of the pin assembly ramps 215. FIG. 6B denotes an angle of the pin assembly ramps 215. When the cam 210 is pressed into position between the side walls 222, 223, of the slider 220, the pin assembly ramps 215 and slider body assembly ramps 227 work together to align the pin ends 213, 214, and the pin holes 228 as well as helps to force the slider body walls 222, 223, apart until the cam 210 snaps together with the slider 220 and forms the sling adjustment 200.

The disclosure recognizes that the spring 230 is beneficial to make the cam 210 engage and tighten a web, such as over tighten side 417 of web 412. To assist, cam spring recession 219 and slider body spring pocket 229 are provided as part of the sling adjustment 200. The spring 230 will preside over pin end 214 with cam spring recession 219 cut or formed into the cam 210 for one of the legs of the spring 230. To make space for the rest of the spring and the other leg, a volume is cut or formed in the wall 223 and can extend down into the center slider bar 224 for slider body spring pocket 229.

Figure 3A:
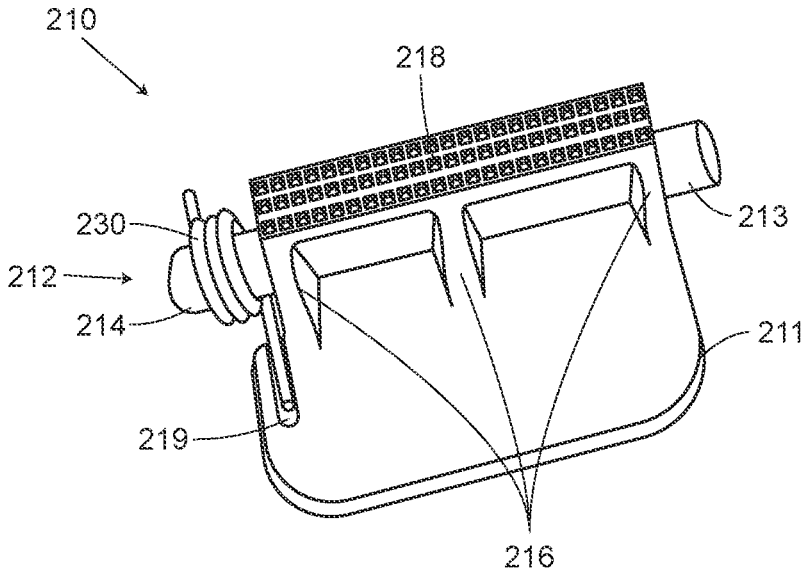
FIG. 3A illustrates a bottom view of the cam of the sling adjustment of FIG. 2.
Figure 3B:
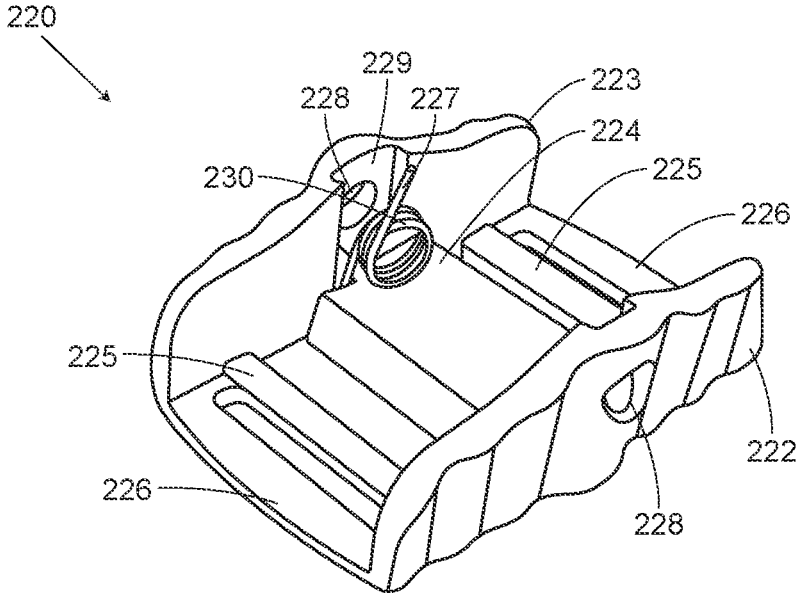
FIG. 3B illustrates a view of the slider of the sling adjustment of FIG. 2.

FIGS. 3A and 3B illustrate an unassembled view of the cam 210 and the slider 220 of sling adjustment 200. In FIGS. 3A and 3B, several components of the cam 210 and the slider 220 that were not visible in FIG. 2 can be seen. FIG. 3A illustrates a bottom view of the cam 210 showing the bottom side of the cam body 211, extruded pin ends 213, 214, with pin assembly ramps 215, the support ribs 216, and the cam teeth 218. The support ribs 216 provided extra material for strength and support. The spring 230 is shown around extruded pin end 214 and is also shown in FIG. 3B on the center slider bar 224. FIG. 3B illustrates a view of the slider 220 of the sling adjustment 200 of FIG. 2. The slider body assembly ramp 227 of the wall 223 can be seen in FIG. 3B. The angle of the slider body assembly ramp 227 corresponds to an angle of the assembly ramp 215 of the extruded end 214.

Turning now generally to FIG. 4, FIG. 4 illustrates an example of a weapon assembly 400 assembled according to the principles of the disclosure. The weapon assembly 400 includes the sling adjustment 200 with a sling 410 that is connected to a weapon 420, which is shown as a rifle in this example. The sling 410 has two pieces of web 411, 412, that make up the body of the sling 410 and a third grip loop 413 that is the grip point of the sling adjustment 200 that can be run as a loop, a tab, a toggle, or completely omitted.

The first piece of web 411 for the body of the sling 410 runs from the rear 422 of the weapon 420 around the back of a user or shooter to a fulcrum ring 414. The web 411 can be padded, unpadded, or adjustable for length of the weapon 420 and shooter girth.

The second piece of web 412 on the sling body, runs from a front attachment point 424 of the weapon 420 through the slider portion of the sling adjustment 200 through the fulcrum ring 414 and back up to the cam portion of the sling adjustment 200 ending in an over tighten loop or tab 415. The side of the web 412 running from the front attachment point 424, through the slider bars 225, to the fulcrum ring 414 can be referred to as a slider side 416 of the web 412. From the fulcrum ring 414 through the cam 210 to the over tighten tab 415 can be referred to as the over tighten side 417 of the web 412. The slider side 416 and the over tighten side 417 are shown in FIG. 5.

FIG. 5 provides a side view of the sling adjustment 200 interacting with the slider side 416 and the over tighten side 417 of the web 412. The slider side 416 weaves around the three slider bars, center slider bar 224 and both of the slider bars 225, which are perpendicular thereto and form the "slider" portion of the sling adjustment 200. The two grip anchor bars 226 to either side of the slider bars 225 serve as anchor points for the grip loop 413, from which the user or operator controls the slider body.

Cam 210 allows the over tighten tab 415 to move freely away from fulcrum ring 414 but will self-engage and lock the over tighten web 417 from moving back towards the fulcrum ring 414 unless the cam 210 is manually released by depressing the thumb tab 217 of the cam body 211. When not released (or activated) the cam teeth 218 will pinch against the top of center slider bar 224 (i.e., the cam pad) to lock the over tighten web 417 from loosening on the side exposed after the slider side 416 has been routed through the fulcrum ring 414.

The thickness of grip anchor rods 226 can be the thickness of the web 412 and thinner than the outer two of the slider bars 225 in order to decrease friction and increase service life of grip loop 413 and slider side 416 by deconflicting the location of grip loop 413 in relation to the routing of the slider side 416 around slider bars 225.

The side view of FIG. 5 also illustrates the antilock wedge 221. To the forward or over tighten tab side of the sling adjustment 200, the cam 210 will press the over tighten tab 415 into the slider side 416 causing binding and preventing the use of the sliding feature in the tightening direction. The addition of the antilock wedge 221 on the forward side of the center slider bar 224 prevents the cam 210 from forcing the over tighten tab 415 into the slider side 416 preventing this conflict while still allowing locking.

Figure 6A:
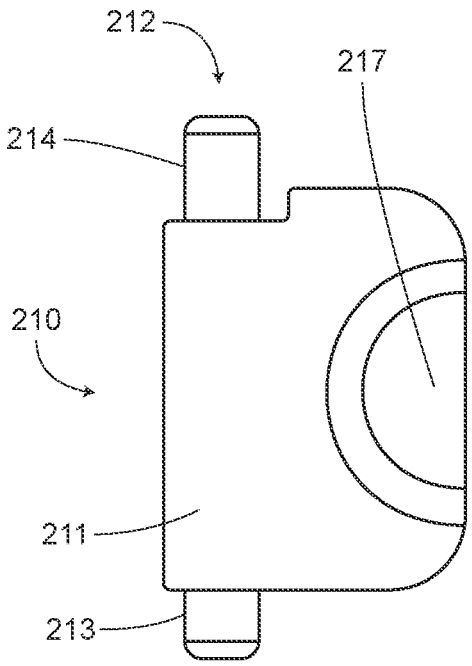
Figure 6B:
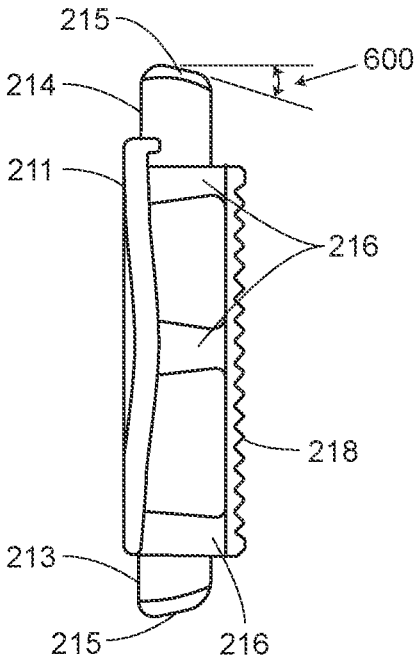
Figure 6C:
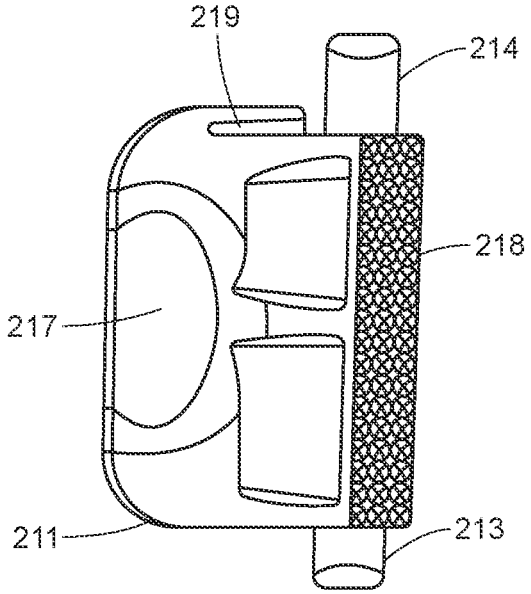
Figure 6D:
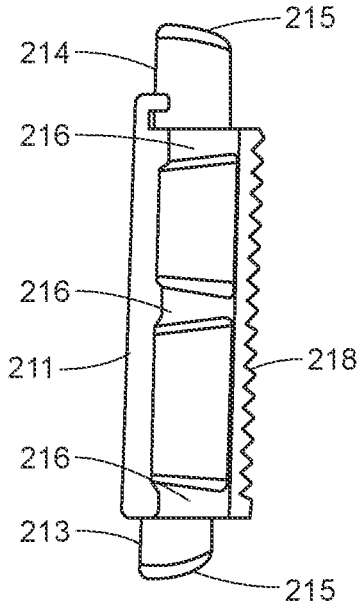
Figure 6E:
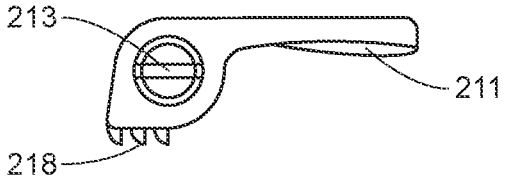

FIGS. 6A to 6E illustrate different views of the cam 210 showing the various components. FIG. 6A illustrates a top view, FIG. 6B a side view from the right side, FIG. 6C a bottom view, FIG. 6D a side view from the left side, and FIG. 6E an end view. An angle 600 is denoted in FIG. 6B to represent the angle of the pin assembly ramps 215, which correspond to the angled slider body assembly ramps 227. As noted above, the cam 210 will press an over-tighten tab 415 into a slider side 416 causing binding and preventing the use of the sliding feature in the tightening direction.

Those skilled in the art to which this application relates will appreciate that other and further additions, deletions, substitutions and modifications may be made to the described embodiments.

What is claimed is:

1. A sling adjustment for a sling, comprising:
- a slider having a pair of side walls;
- a center slider bar extending between the sidewalls, wherein the center slide bar has an antilock wedge located on a forward side of the center slider bar; and
- a cam, positioned within the pair of side walls having teeth for engaging with the sling.

2. The sling adjustment as recited in claim 1, wherein the cam further includes a first and a second extruded pin end.

3. The sling adjustment as recited in claim 2, wherein at least one of the extruded pin ends includes a pin assembly ramp.

4. The sling adjustment as recited in claim 3, wherein each of the pair of side walls includes a pin hole that corresponds to one of the first or the second extruded pin ends, and at least one of the side walls includes a slider body assembly ramp that corresponds to the pin assembly ramp.

5. The sling adjustment as recited in claim 2, further comprising a spring positioned around the first extruded pin end.

6. The sling adjustment as recited in claim 5, wherein one of the pair of side walls includes a spring pocket that corresponds to the spring.

7. The sling adjustment as recited in claim 5, wherein the cam includes a recession for at least one leg of the spring.

8. The sling adjustment as recited in claim 1, wherein the slider further comprises grip anchor bars and slider bars, wherein a thickness or diameter of the slider bars is greater than a thickness or diameter of the grip anchor bars.

9. The sling adjustment as recited in claim 8, wherein one of the grip anchor bars are located on opposite sides of the center slider bar and each one of the slider bars are located between one of the grip anchor bars and the center slide bar.

10. The sling adjustment as recited in claim 9, wherein each of the slider bars has a first side that is on a side of the grip anchor bars and a second side that is on a side of the center slider bar, and the first side of each of the slider bars is thicker than the second side of each of the slider bars.

11. The sling adjustment as recited in claim 1, wherein the slider and the cam are constructed via injection molding.

12. The sling adjustment as recited in claim 1, wherein the cam includes teeth that correspond to a top side of the center slide bar.

13. A weapon sling, comprising:
- a first piece of web; and
- a sling adjustment integrated with a portion of the first piece of web, wherein the sling adjustment includes:
  - a slider having a pair of side walls;
  - a center slider bar extending between the sidewalls, wherein the center slide bar has an antilock wedge located on a forward side of the center slider bar; and
  - a cam, positioned within the pair of side walls having teeth for engaging with the first piece of the web.

14. The weapon sling as recited in claim 13, further comprising a second piece of web and a fulcrum ring, wherein the first and second piece of web pass through the fulcrum ring.

15. The weapon sling as recited in claim 14, wherein the slider further comprises grip anchor bars and slider bars.

16. The weapon sling as recited in claim 15, further comprising a grip loop that is attached to the grip anchor bars.

17. The weapon sling as recited in claim 13, wherein the cam further includes a first and a second extruded pin end that each include a pin assembly ramp.

18. The weapon sling as recited in claim 17, wherein the sling adjustment further includes a spring positioned around the first extruded pin end and configured to encourage operation of the cam.

19. A weapon assembly, comprising:
- a weapon; and
- a weapon sling connected to the weapon, the weapon sling comprising:
  - a first piece of web connected to an end of the weapon; and
  - a sling adjustment integrated with a portion of the first piece of web, wherein the sling adjustment includes:
    - a slider having a pair of side walls;
    - a center slider bar extending between the sidewalls, wherein the center slide bar has an antilock wedge located on a forward side of the center slider bar; and
  - a cam, positioned within the pair of side walls having teeth for engaging with the first piece of the web.

20. The weapon assembly of claim 19, wherein the weapon is a rifle.

* * * * *